US009812281B2

(12) United States Patent
Lu et al.

(10) Patent No.: US 9,812,281 B2
(45) Date of Patent: Nov. 7, 2017

(54) X-RAY SOURCE AND X-RAY IMAGING METHOD

(71) Applicant: Industrial Technology Research Institute, Hsinchu (TW)

(72) Inventors: Hui-Hsin Lu, New Taipei (TW); Wei-Hsin Wang, Taipei (TW); Jiun-Lin Guo, Hsinchu (TW); Shih-Chung Lee, Miaoli County (TW)

(73) Assignee: Industrial Technology Research Institute, Hsinchu (TW)

( * ) Notice: Subject to any disclaimer, the term of this patent is extended or adjusted under 35 U.S.C. 154(b) by 273 days.

(21) Appl. No.: 14/537,910

(22) Filed: Nov. 11, 2014

(65) Prior Publication Data

US 2015/0340190 A1 Nov. 26, 2015

(30) Foreign Application Priority Data

May 23, 2014 (TW) ..... 103118063 A

(51) Int. Cl.
*H01J 35/06* (2006.01)
*H01J 35/10* (2006.01)
(Continued)

(52) U.S. Cl.
CPC ..... *H01J 35/10* (2013.01); *H01J 35/16* (2013.01); *H01J 35/18* (2013.01); *H01J 35/24* (2013.01);
(Continued)

(58) Field of Classification Search
CPC .. H01J 35/06; H01J 35/10; H01J 35/16; H01J 35/18; H01J 35/24; H01J 2235/08;
(Continued)

(56) References Cited

U.S. PATENT DOCUMENTS 3,610,984 A * 10/1971 Seki ..... H01J 35/10 378/115
4,411,013 A 10/1983 Takasu et al.
(Continued)

FOREIGN PATENT DOCUMENTS

CN 1992141 10/2013
WO 2013004574 1/2013

OTHER PUBLICATIONS

"Chapter 6: The X-Ray Tube," Wenatchee High School, Radiation Physics Lecture Notes, Retrieved Oct. 31, 2014, Available at: http://whs.wsd.wednet.edu/faculty/busse/mathhomepage/busseclasses/radiationphysics/lecturenotes/chapter6/chapter6.html.
(Continued)

*Primary Examiner* — Allen C. Ho
(74) *Attorney, Agent, or Firm* — JCIPRNET

(57) ABSTRACT

An X-ray imaging method including the following steps is provided. An X-ray source is provided, wherein the X-ray source includes a housing, a cathode, and an anode target. The housing has an end window. The cathode is disposed in the housing, and the anode target is disposed beside the end window. The cathode is caused to provide an electron beam. A portion of the electron beam hits at least a part of areas of the anode target to generate an X-ray and the X-ray is emitted out of the housing through the end window. The X-ray is caused to irradiate an object to generate X-ray image information. An image detector is used to receive the X-ray image information.

18 Claims, 8 Drawing Sheets

(51) Int. Cl.
*H01J 35/16* (2006.01)
*H01J 35/18* (2006.01)
*H01J 35/24* (2006.01)
*G21K 1/04* (2006.01)

(52) U.S. Cl.
CPC ..... *G21K 1/043* (2013.01); *H01J 35/06* (2013.01); *H01J 2235/08* (2013.01); *H01J 2235/086* (2013.01); *H01J 2235/168* (2013.01); *H01J 2235/18* (2013.01)

(58) Field of Classification Search
CPC . H01J 2235/086; H01J 2235/18; A61B 6/482; A61B 6/484
USPC .... 378/98.9, 98.11, 125, 140, 143, 144, 124
See application file for complete search history.

(56) References Cited

U.S. PATENT DOCUMENTS 4,712,226 A * 12/1987 Horbaschek ..... H01J 35/06 378/124
5,065,419 A * 11/1991 Leguen ..... H01J 35/14 378/121
5,511,105 A * 4/1996 Knott ..... H01J 35/24 378/125
5,757,885 A * 5/1998 Yao ..... H05G 1/025 378/125
5,857,008 A 1/1999 Reinhold
5,907,592 A * 5/1999 Levinson ..... H01J 35/10 378/144
6,215,852 B1 * 4/2001 Rogers ..... H01J 35/105 378/141
6,226,353 B1 * 5/2001 Wilkins ..... A61B 6/484 378/98.11
6,259,765 B1 7/2001 Baptist
6,263,046 B1 * 7/2001 Rogers ..... F28D 15/02 378/140
6,487,274 B2 * 11/2002 Bertsche ..... A61N 5/10 378/124
6,553,096 B1 * 4/2003 Zhou ..... A61B 6/4488 378/122
6,560,315 B1 * 5/2003 Price ..... H01J 35/10 378/125
6,594,341 B1 * 7/2003 Lu ..... H01J 35/18 378/140
6,983,035 B2 * 1/2006 Price ..... H01J 35/08 378/124
7,065,179 B2 * 6/2006 Block ..... H01J 35/10 378/124
7,120,222 B2 * 10/2006 Hoffman ..... A61B 6/032 378/124
7,187,756 B2 * 3/2007 Gohno ..... G01N 23/046 378/124
7,224,771 B2 * 5/2007 Levene ..... H01J 35/02 378/136
7,317,785 B1 * 1/2008 Zou ..... H01J 35/04 378/12
7,483,518 B2 * 1/2009 Hamill ..... G21K 1/10 378/119
7,489,763 B2 * 2/2009 Lenz ..... H01J 35/105 378/125
7,496,176 B2 2/2009 Aslund
7,551,722 B2 6/2009 Ohshima et al.
7,643,614 B2 * 1/2010 Hebert ..... H01J 35/105 378/129
7,649,981 B2 * 1/2010 Seppi ..... A61B 6/032 378/124
7,693,256 B2 4/2010 Brahme et al.
7,720,200 B2 * 5/2010 Steinlage ..... H01J 35/10 378/128
7,796,737 B2 * 9/2010 Allen ..... H01J 35/18 378/121
7,817,777 B2 * 10/2010 Baumann ..... A61B 6/00 378/36
7,852,979 B2 * 12/2010 Edic ..... A61B 6/032 378/134
7,869,571 B2 * 1/2011 Hsieh ..... A61B 6/032 378/124
7,869,572 B2 * 1/2011 Allen ..... H01J 35/16 378/140
7,869,574 B2 * 1/2011 Steinlage ..... C25D 5/10 228/262.31
7,869,862 B2 * 1/2011 Seppi ..... A61B 6/032 600/420
7,949,102 B2 * 5/2011 Behling ..... A61B 6/032 378/119
8,116,432 B2 * 2/2012 Steinlage ..... H01J 35/10 378/143
8,121,259 B2 * 2/2012 Hebert ..... H01J 35/16 378/140
8,126,116 B2 * 2/2012 Bathe ..... H01J 35/10 378/125
8,189,742 B2 * 5/2012 Behling ..... H01J 35/10 378/124
8,483,361 B2 * 7/2013 Sainath ..... A61B 6/027 378/125
8,520,803 B2 * 8/2013 Behling ..... H01J 35/10 378/124
8,553,843 B2 * 10/2013 Drory ..... H01J 35/108 378/125
8,553,844 B2 * 10/2013 Lewalter ..... H01J 35/108 378/125
9,099,279 B2 * 8/2015 Rommel ..... H01J 35/10
9,257,254 B2 * 2/2016 Ogura ..... H01J 35/08
9,263,226 B2 * 2/2016 Zhao ..... G01N 23/04
9,390,881 B2 * 7/2016 Yun ..... G21K 1/06
9,418,816 B2 * 8/2016 Kondo ..... A61B 6/032
9,420,676 B2 * 8/2016 Chen ..... H05G 1/025
9,424,958 B2 * 8/2016 Vogtmeier ..... G21K 1/10
9,543,109 B2 * 1/2017 Yun ..... H01J 35/12
2002/0041653 A1 4/2002 Wilkins et al.
2011/0211676 A1 * 9/2011 Dorscheid ..... H01J 35/08 378/121
2012/0140885 A1 6/2012 Iwakiri et al.
2014/0126698 A1 * 5/2014 Behling ..... H01J 35/10 378/62
2014/0177794 A1 * 6/2014 De Man ..... H01J 35/26 378/62
2014/0348301 A1 * 11/2014 Lee ..... H01J 35/10 378/125
2015/0092924 A1 * 4/2015 Yun ..... H01J 35/12 378/143

OTHER PUBLICATIONS

"Office Action of Taiwan Counterpart Application", dated Jan. 6, 2016, p. 1-p. 8, in which the listed reference was cited.
Yunzhe Zhao, et al, "High-resolution, low-dose phase contrast X-ray tomography for 3D diagnosis of human breast cancers," PNAS, vol. 109, No. 45, Nov. 6, 2012, pp. 18290-18294.
T. E. Gureyev, et al., "Refracting Röntgen's rays: Propagation-based x-ray phase contrast for biomedical imaging," Journal of Applied Physics, vol. 105, May 2009, pp. 102005-1-102005-12.
Jani Keyril Äinen, et al., "Phase-contrast X-ray imaging of breast," Acta Radiologica, Oct. 2010, pp. 866-884.
Christian Kottler, et al, "Phase sensitive X-ray imaging: Towards medical applications," 2010 IEEE Nuclear Science Symposium Conference Record (NSS/MIC), Oct. 30, 2010-Nov. 6, 2010, pp. 2445-2448.
Da Zhang, et al, "Preliminary Feasibility Study of an In-line Phase Contrast X-Ray Imaging Prototype," IEEE Transactions on Biomedical Engineering, vol. 55, No. 9, Sep. 2008, pp. 2249-2257.
Franz Pfeiffer, et al., "Phase retrieval and differential phase-contrast imaging with low-brilliance X-ray sources," nature physics, vol. 2, Apr. 2006, pp. 258-261.
Alberto Bravin, et al, "X-ray phase-contrast imaging: from pre-clinical applications towards clinics," Physics in Medicine and Biology, Jan. 2013, pp. R1-R35.

(56) References Cited

OTHER PUBLICATIONS

Sheridan C. Mayo, et al., "In-Line Phase-Contrast X-ray Imaging and Tomography for Materials Science," Materials, vol. 5, May 2012, pp. 937-965.
F. Pfeiffer, et al., "Hard X-Ray Phase Tomography with Low-Brilliance Sources," Physical Review Letters, vol. 98, Mar. 9, 2007, pp. 108105-1-108105-4.
Christian Kottlera, et al., "Recent Developments on X-ray Phase Contrast Imaging Technology at CSEM," AIP Conf. Proc. 1446, Mar. 5-7, 2012, pp. 18-22.
Marco Stampanoni, et al., "The First Analysis and Clinical Evaluation of Native Breast Tissue Using Differential Phase-Contrast Mammography," Preliminary Report, vol. 46, No. 12, Dec. 2011, pp. 801-806.

* cited by examiner

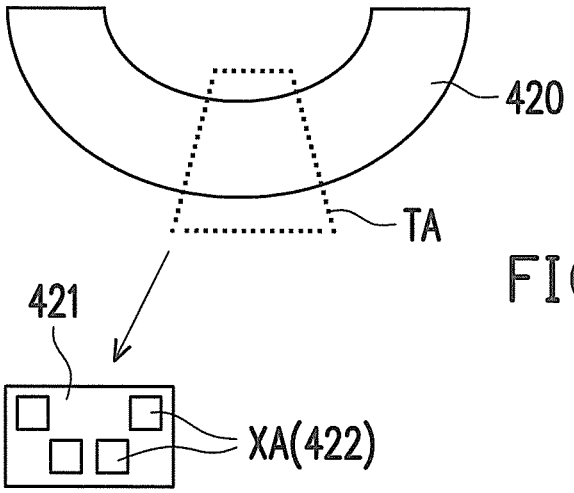
FIG. 5A
FIG. 5B
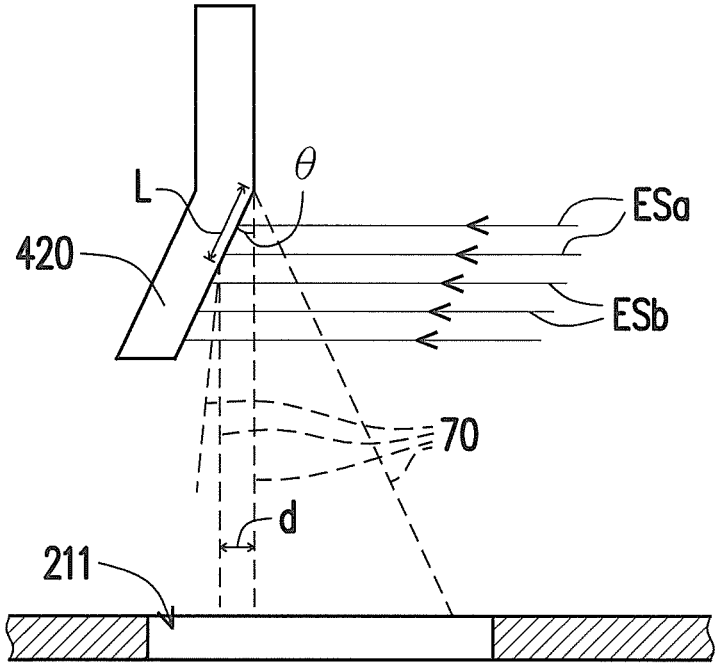
FIG. 5C

622

X-RAY SOURCE AND X-RAY IMAGING METHOD

CROSS-REFERENCE TO RELATED APPLICATION

This application claims the priority benefit of Taiwan application serial no. 103118063, filed on May 23, 2014. The entirety of the above-mentioned patent application is hereby incorporated by reference herein and made a part of this specification.

TECHNICAL FIELD

This technical field relates to an X-ray source and an X-ray imaging method.

BACKGROUND

X-ray medical imaging is a non-invasive method for inspecting the human body structure and is applicable to rapidly obtaining anatomical information (e.g., the shapes/structures of bones, organs, and soft tissues) of the subject without actually performing dissection or obtaining a histological section for medical diagnoses. The conventional X-ray imaging uses an energy range of higher frequency, which has good recognition capability for bones and soft tissues and is therefore commonly used for skeletal radiography. However, the compositions of soft tissues at different parts of the human body do not differ much from each other. As a result, the difference between the compositions of soft tissues is not obvious in the image of the X-ray energy range of skeletal radiography, and it can hardly be used for medical diagnoses. Thanks to X-ray image digitization that developed in the recent years, it has become possible to radiograph soft tissues. For instance, soft tissues may be inspected by using the phase contrast X-ray imaging (PCXI) technology, which utilizes an X-ray source as the ray source of the phase contrast imaging system.

Generally, the current phase contrast X-ray imaging (PCXI) technology may be roughly categorized into in-line based PCXI and grating based PCXI. Because the grating based PCXI has problems such as high dose, long imaging time, longer imaging distance, it is difficult to meet the standard of clinical use. The micro-focal-spot ray source currently used in the in-line based PCXI is a continuous ray source that generally uses power of 75 W, and the micro focal spot formed is about 50 μm. Compared with the ray source power of 1000 W (the micro focal spot is about 100 μm) or 3000 W (the micro focal spot is about 300 μm) for clinical mammography, the PCXI that uses the current micro-focal-spot ray source does not provide sufficient power for radiographing clinical samples.

In addition, the PCXI mostly uses magnets to focus the electron beam, which further concentrates the heat that accompanies the X-ray generated when the electron beam hits the anode target. In order to avoid meltdown of the anode target, the power of the X-ray source is limited. Thus, how to enhance the power of the X-ray source while reducing the risk of meltdown of the anode target is an important issue in this field.

SUMMARY

According to an embodiment of this disclosure, an X-ray source is adapted to providing an X-ray and includes a housing, an anode target, a cathode, and a shielding unit. The housing has an end window, wherein the X-ray is emitted out of the housing through the end window. The anode target is disposed beside the end window. The cathode is disposed in the housing and adapted to providing an electron beam, wherein a portion of the electron beam hits the rotating anode target to generate the X-ray that passes through the end window. The shielding unit has an opening and is disposed on a traveling path of the electron beam and located between the cathode and the anode target. The shielding unit is configured to shield another portion of the electron beam, wherein the portion of the electron beam that hits the anode target penetrates the shielding unit through the opening of the shielding unit.

According to an embodiment of this disclosure, an X-ray source is adapted to providing an X-ray and includes a housing, an anode target, and a cathode. The housing has an end window, wherein the X-ray is emitted out of the housing through the end window. The anode target is disposed beside the end window, wherein the anode target includes a plurality of X-ray generating areas. The cathode is disposed in the housing and adapted to providing an electron beam, wherein a portion of the electron beam hits the X-ray generating areas of the rotating anode target while another portion of the electron beam hits areas other than the X-ray generating areas of the rotating anode target. The X-ray that passes through the end window is generated by the hitting of the portion of the electron beam on the X-ray generating areas.

According to an embodiment of this disclosure, an X-ray imaging method includes the following. An X-ray source is provided, wherein the X-ray source includes a housing, a cathode, and an anode target. The housing has an end window. The cathode is disposed in the housing, and the anode target is disposed beside the end window. The cathode is caused to provide an electron beam. A portion of the electron beam hits at least a part of areas of the rotating anode target to generate an X-ray and the X-ray is emitted out of the housing through the end window. The X-ray is caused to irradiate an object to generate X-ray image information. An image detector is used to receive the X-ray image information.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

FIG. 5A is a schematic front view of an anode target of the X-ray source of FIG. 4.

FIG. 5B is a schematic enlarged view of a partial area of the anode target of FIG. 5A.

FIG. 5C is a schematic view of an X-ray generated by the X-ray source of FIG. 5A.

DETAILED DESCRIPTION OF DISCLOSED EMBODIMENTS

Figure 1:
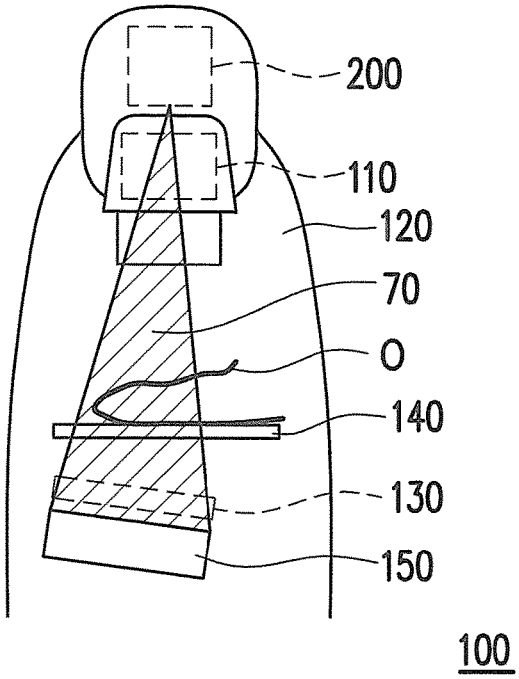
FIG. 1 is a schematic view of an X-ray imaging system according to an embodiment of the disclosure.

FIG. 1 is a schematic view of an X-ray imaging system 100 according to an embodiment of the disclosure. With reference to FIG. 1, an X-ray imaging system 100 of this embodiment includes an X-ray source 200, a first collimator 110, an abutment 120, a second collimator 130, a support 140, and an image detector 150. In this embodiment, the X-ray imaging system 100 is a phase contrast X-ray imaging (PCXI) system, for example. More specifically, in this embodiment, as shown in FIG. 1, the X-ray source 200 is adapted to providing the X-ray imaging system 100 an X-ray 70. The X-ray source 200 is disposed at an upper end of the abutment 120. The support 140 is disposed at a lower end of the abutment 120 and is adapted for carrying an object O thereon. The first collimator 110 is disposed between the support 140 and the X-ray source 200 for collimating the X-ray 70 emitted by the X-ray source 200, so as to cause the X-ray 70 to irradiate the object O. After being emitted by the X-ray source 200, the X-ray 70 irradiates the object O to generate X-ray image information. The second collimator 130 is disposed between the object O and the image detector 150 for collimating the X-ray image information, such that the X-ray image information is received by the image detector 150. The image detector 150 is disposed under the support 140 and is fixed at the lower end of the abutment 120. The X-ray image information is transmitted to the image detector 150 through the second collimator 130 and received by the image detector 150. Moreover, in this embodiment, the X-ray imaging system 100 is provided with the X-ray source 200 instead of a grating. Therefore, an imaging distance D is maintained within 70 cm in compliance with the regulations of mammography. In addition, the imaging distance D is not limited to the above if an imaging absorbed dose of the object O is within a range (<3 mGy) permissible according to the regulations while the image contrast satisfies the needs of clinical diagnoses. In other embodiments, the second collimator 130 may not be used in order to reduce the dose without affecting the image quality.

Figure 2:
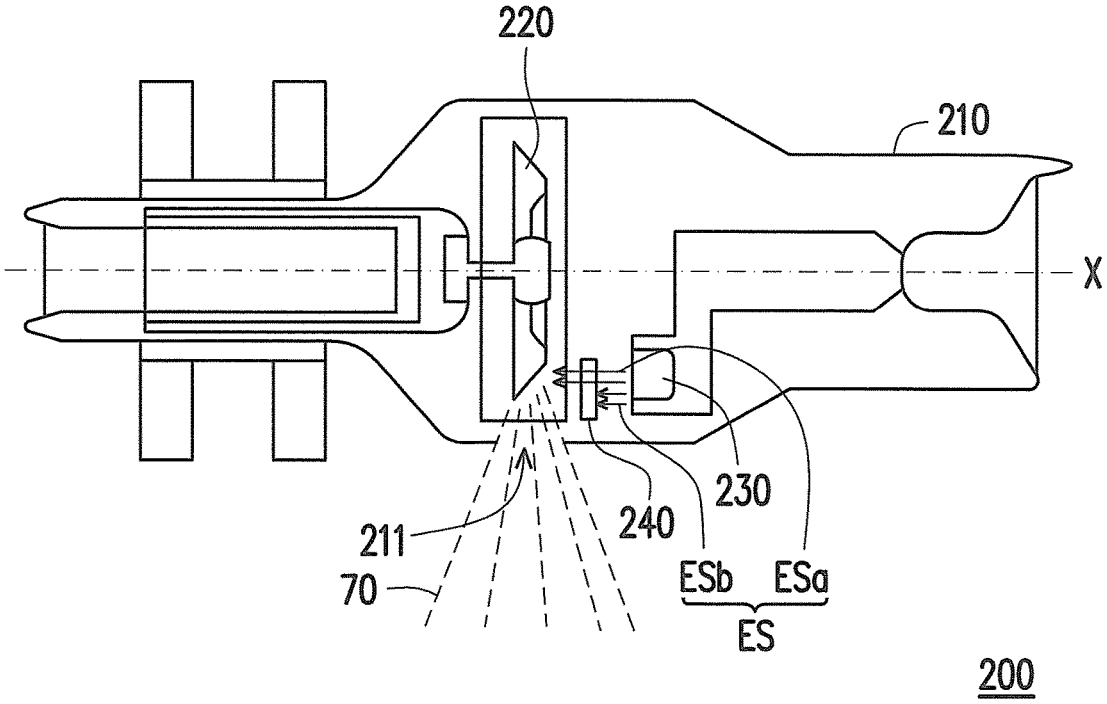
FIG. 2 is a schematic view of an X-ray source of FIG. 1.

FIG. 2 is a schematic view of the X-ray source 200 of FIG. 1. To be more detailed, referring to FIG. 2, an X-ray source 200 of this embodiment includes a housing 210, an anode target 220, and a cathode 230. The housing 210 has an end window 211, wherein the X-ray 70 is emitted out of the housing 210 through the end window 211. The anode target 220 is disposed beside the end window 211. In this embodiment, the anode target 220 is adapted to rotating around an axis X. The cathode 230 is disposed in the housing 210 and adapted to providing an electron beam ES, wherein a portion ESa of the electron beam ES hits the rotating anode target 220 to generate the X-ray 70 that passes through the end window 211.

In this embodiment, the X-ray source 200 further includes a shielding unit 240 disposed on a traveling path of the electron beam ES and located between the cathode 230 and the anode target 220 for allowing the portion ESa of the electron beam ES to pass and shielding another portion ESb of the electron beam ES. Accordingly, the area of the anode target 220 hit by the electron beam ES is reduced to turn the X-ray into the X-ray 70, which is a smaller beam, so as to form a small point ray source and thereby achieve the subsequent phase contrast imaging effect. Moreover, the risk of meltdown of the anode target 220 due to excessive concentration of the heat that occurs when the electron beam ES hits the anode target 220 is also reduced. The structure of the shielding unit 240 is described in detail below with reference to FIG. 3A to FIG. 3E.

Figure 3A:
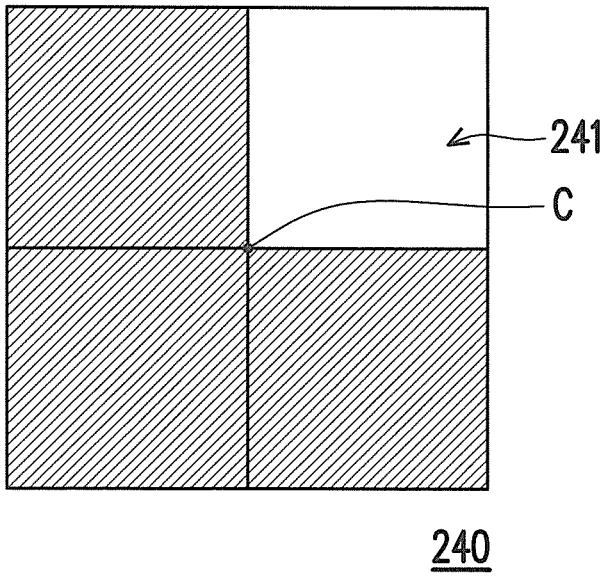
FIG. 3A is a schematic view of a shielding unit of FIG. 2.
Figure 3B:
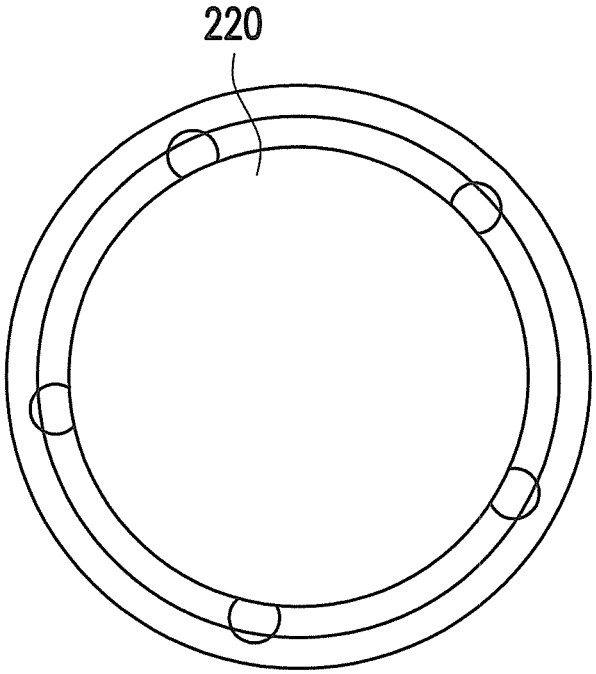
FIG. 3B is a schematic front view of an anode target of the X-ray source of FIG. 2.
Figure 3C:
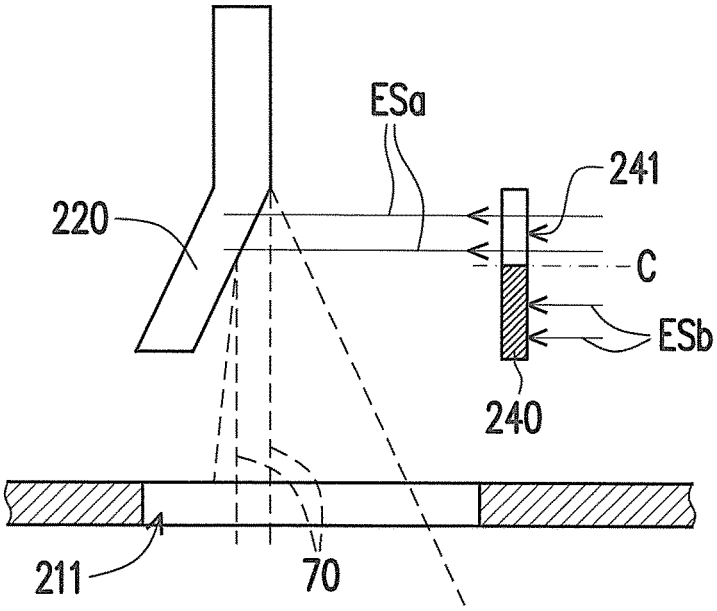
FIG. 3C is a schematic view of an X-ray generated by the X-ray source of FIG. 2.

FIG. 3A is a schematic view of the shielding unit 240 of FIG. 2. FIG. 3B is a schematic front view of the anode target 220 of the X-ray source 200 of FIG. 2. FIG. 3C is a schematic view of the X-ray 70 generated by the X-ray source 200 of FIG. 2. For instance, referring to FIG. 3A and FIG. 3B, in this embodiment, the shielding unit 240 is a shutter having an opening 241. More specifically, as shown in FIG. 3B, in this embodiment, a central axis C of the shielding unit 240 is consistent with a central point of the electron beam ES, and the shielding unit 240 rotates around the central axis C. The opening 241 allows the portion ESa of the electron beam ES to hit partial areas of the anode target 220. In some embodiments, the shielding unit 240 may not rotate, and the area of the anode target 220 hit by the electron beam ES may be reduced without a movement as long as the heat load permits. In that case, the opening 241 may be positioned at any part of the shielding unit 240, and a center thereof is aligned with the center of the electron beam ES.

Accordingly, as shown in FIG. 2, FIG. 3B, and FIG. 3C, the portion ESa of the electron beam ES that is to hit the anode target 220 passes through the shielding unit 240 through the opening 241 of the shielding unit 240 and hits the anode target 220. Because the anode target 220 rotates continuously, the portion ESa of the electron beam ES that passes through the shielding unit 240 hits different areas of the anode target 220, causing the hit area of the anode target 220 to reduce and turning the X-ray into the small X-ray 70, so as to form the small ray source and achieve the subsequent phase contrast effect. In addition, the risk of meltdown of the anode target 220 due to excessive concentration of the heat that occurs when the electron beam ES hits the anode target 220 is also reduced. Furthermore, in this embodiment, a micro-focal-spot shape of the X-ray source 200 is square. Thus, in this embodiment, the opening 241 of the shielding unit 240 is designed to be square as well. However, it should be noted that this disclosure is not limited thereto. In other embodiments, the opening 241 of the shielding unit 240 may be circular or in other shapes according to the actual requirements of design. Moreover, in order that the portion ESa of the electron beam ES can pass through the shielding unit 240 successfully, a potential of the portion ESa of the electron beam ES is the same as the cathode 230 in an embodiment.

On the other hand, because only the portion ESa of the electron beam ES passes through the shielding unit 240 and hits the rotating anode target 220, the area of the object O irradiated by the X-ray 70 of the X-ray source 200 is relatively small, so as to meet the requirement of a reduced ray for phase contrast. Thus, in this embodiment, an imaging method of the X-ray imaging system 100 includes performing a sequential scanning in accordance with a rotation speed of the anode target 220 and a rotation speed of the opening 241 of the shielding unit 240. If the rotation speed of the anode target 220 is too fast, the imaging method is performed only in accordance with the rotation speed of the shielding unit 240. More specifically, when the rotation speed of the anode target 220 is very fast, a hit track of the portion ESa of the electron beam ES on the anode target 220 presents a sinusoidal shape, and a fluctuation range thereof does not exceed the area of the anode target 220 originally shielded from being hit by the electron beam ES. Details are further described below with reference to FIG. 3D.

Figure 3D:
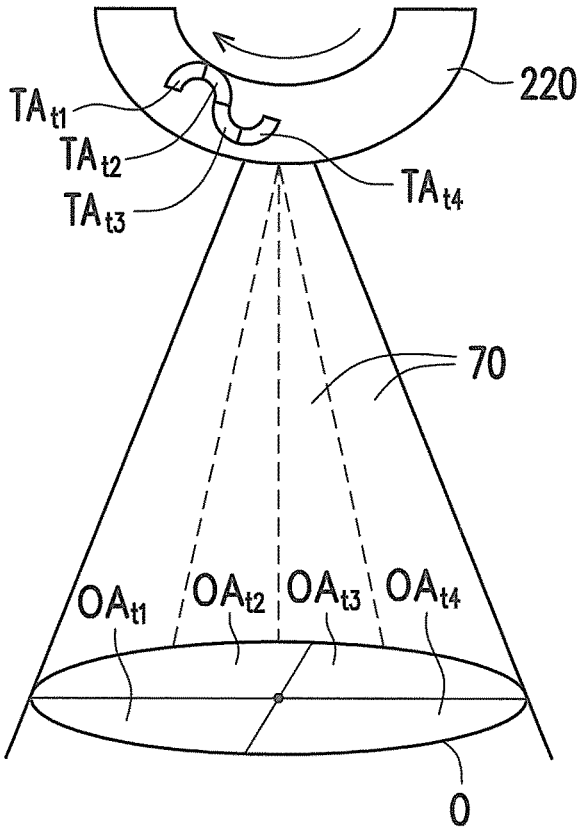
FIG. 3D is a schematic view of the X-ray of FIG. 3C irradiating an object.

FIG. 3D is a schematic view of the X-ray 70 of FIG. 3C irradiating the object O. In this embodiment, the X-ray imaging system 100 is capable of scanning the object O. Because the area of the object O irradiated by the X-ray 70 is relatively small, the scanning is performed by sections so as to form a complete image. For example, in this embodiment, the X-ray imaging system 100 causes the portion ESa of the electron beam ES to hit different areas, i.e., $TA_{t1}$, $TA_{t2}$, $TA_{t3}$, and $TA_{t4}$, of the rotating anode target 220 in sequence at times t1, t2, t3, and t4 and causes the X-ray 70 to irradiate different areas of the object O so as to scan different areas, i.e., $OA_{t1}$, $OA_{t2}$, $OA_{t3}$, and $OA_{t4}$, of the object O. Thus, the X-ray imaging system 100 may respectively set the range required for each scanning. For example, in this embodiment, the rotation speed of the shielding unit 240 is set such that one rotation of the shielding unit 240 takes an exposure time T so as to complete one single radiograph, and the scanning of the entire imaging areas $OA_{t1\sim4}$ is performed clockwise or counterclockwise. In another embodiment, an imaging time t of the object O is a multiple of a ratio of the areas of the electron beam ES reduced by the shielding unit 240 (i.e., the ratio of the area of the electron beam ES to the area of the portion ESa of the electron beam ES).

On the other hand, in a condition of not changing a flow rate (i.e., electron density per unit area) of the electron beam ES, because the number of the electrons that hit the anode target 220 decreases, heat dissipation efficiency is improved. However, it should be noted that this disclosure is not limited thereto. In another embodiment, the density of the electron beam ES may be selectively increased to decrease the imaging area and reduce displacement of the imaged part (e.g., spontaneous movement or organ activity of the patient). Since those skilled in the art may determine the density of the electron beam ES according to their actual needs, details are not provided here.

Accordingly, the X-ray imaging system 100 of this embodiment causes the portion ESa of the electron beam ES of the X-ray source 200 to hit different areas of the rotating anode target 220 so as to reduce the hit areas of the anode target 220 and turn the X-ray to the small X-ray 70, thereby forming a small point ray source and achieving the subsequent phase contrast effect. Moreover, the risk of meltdown of the anode target 220 due to excessive concentration of the heat that occurs when the electron beam ES hits the anode target 220 is also reduced. Therefore, in a situation where the power of the X-ray source 200 is enhanced, the X-ray imaging system 100 and the X-ray source 200 of this embodiment maintain a certain degree of reliability and are applicable for radiographing clinical samples.

The above embodiment illustrates that the X-ray source 200 is provided with the shielding unit 240 such that the portion ESa of the electron beam ES hits at least a part of areas of the rotating anode target 220 so as to reduce the hit area of the anode target 220. However, it should be noted that this disclosure is not limited thereto. Possible variations of the X-ray source 200 are further explained below with reference to FIG. 4 to FIG. 7B.

Figure 4:
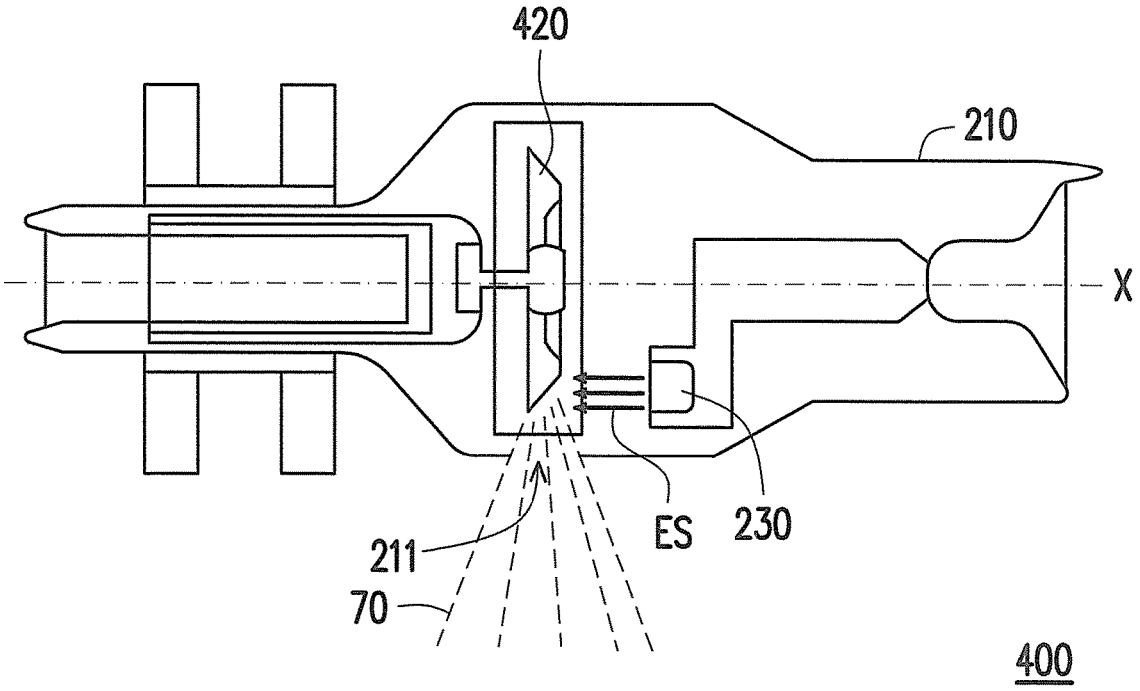
FIG. 4 is a schematic view of another X-ray source of FIG. 1.

FIG. 4 is a schematic view of another X-ray source 400 of FIG. 1. FIG. 5A is a schematic front view of an anode target 420 of the X-ray source 400 of FIG. 4. FIG. 5B is a schematic enlarged view of a partial area TA of the anode target 420 of FIG. 5A. FIG. 5C is a schematic view of an X-ray 70 generated by the X-ray source 400 of FIG. 5A. With reference to FIG. 4 to FIG. 5C, in this embodiment, an X-ray source 400 of FIG. 4 is similar to the X-ray source 200 of FIG. 2, and a difference therebetween is described below. More specifically, in this embodiment, as shown in FIG. 4 and FIG. 5C, an anode target 420 of the X-ray source 400 includes a plurality of X-ray generating areas XA (422), and the X-ray source 400 does not include the shielding unit 240 or any similar component. Therefore, after the electron beam ES leaves the cathode 230, the electron beam ES hits areas of the rotating anode target 420 directly, wherein the portion ESa of the electron beam ES hits the X-ray generating areas XA of the anode target 420 and is blocked by atoms of the X-ray generating areas XA (422) and converted to generate the X-ray 70, and another portion ESb of the electron beam ES hits areas other than the X-ray generating areas XA of the anode target 420. The another portion ESb of the electron beam ES is not blocked by the atoms nor enters a substrate that causes generation of X-ray. Therefore, the X-ray 70 is not generated. The X-ray 70 generated by the hitting of the portion ESa of the electron beam ES on the X-ray generating areas XA is emitted out through the end window 211.

To be more specific, with reference to FIG. 4 to FIG. 5B, in this embodiment, the anode target 420 of the X-ray source 400 includes a first substrate 421 and a second substrate 422. For example, the first substrate 421 is formed of a material that does not generate X-ray, and the second substrate 422 is formed of a material capable of generating X-ray. The second substrate 422 is formed on the first substrate 421 in an inlaid manner, so as to form the anode target 420. More specifically, the second substrate 422 is disposed between the first substrate 421 and the cathode 230 and partially covers a surface of the first substrate 421 to form the X-ray generating areas XA. With reference to FIG. 4, FIG. 5B, and FIG. 5C, when the electron beam ES leaves the cathode 230 and directly hits areas of the rotating anode target 420, the portion ESa of the electron beam ES hits the second substrate 422 and generates the X-ray 70 that passes through the end window 211. Specifically, as shown in FIG. 5C, the size of the second substrate 422 is L, the relationship between the focal spot d of the formed X-ray 70 and a vertical angle θ of the target surface is $d=L \cdot \sin\theta$. Generally, when d is less than or equal to 50μm, the phase contrast effect is generated. Moreover, in this embodiment, the imaging time t of the object O is a multiple obtaining by dividing a sum of the area of the first substrate 421 and the area of the second substrate 422 by thearea of the second substrate 422, so as to obtain a sufficient image contrast of the object O. That is, the imaging time t of the object O is the multiple of the area of the electron beam ES reduced by the anode target 420. In addition, in this embodiment, because the another portion ESb of the electron beam ES that hits the first substrate 421 does not cause generation of the X-ray 70, heat that accompanies the X-ray 70 generated by the anode target 420 is reduced effectively. Further, in this embodiment, the first substrate 421 may be a heat dissipation substrate to help dissipate heat of the anode target 420 and further reduce the risk of meltdown of the anode target 420 due to excessive concentration of the heat that occurs when the electron beam ES hits the anode target 420. Accordingly, the X-ray source 400 achieves effects similar to the X-ray source 200. Details thereof are not repeated hereinafter.

Figure 6A:
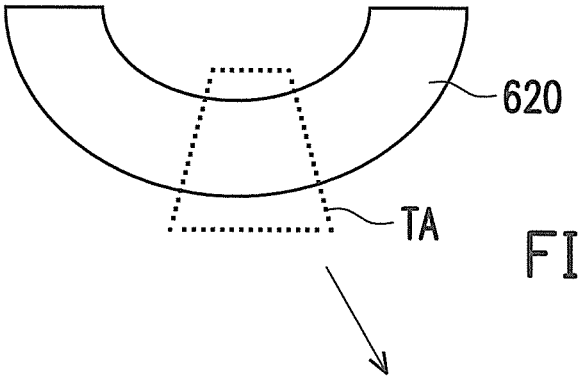
FIG. 6A is a schematic front view of another anode target of the X-ray source of FIG. 4.
Figure 6B:
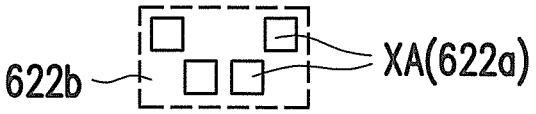
FIG. 6B is a schematic enlarged view of a partial area of the anode target of FIG. 6A.

FIG. 6A is a schematic front view of another anode target 620 of the X-ray source 400 of FIG. 4. FIG. 6B is a schematic enlarged view of a partial area of the anode target 620 of FIG. 6A. With reference to FIG. 6A and FIG. 6B, in this embodiment, an anode target 620 of FIG. 6B is similar to the anode target 420 of FIG. 5B, and a difference therebetween is described below. More specifically, as shown in FIG. 6B, in this embodiment, the anode target 620 includes a second substrate 622 but does not include the first substrate 421, wherein the second substrate 622 and the second substrate 422 are formed of the same material. To be more specific, in this embodiment, the second substrate 622 further includes a plurality of hit areas 622*a* and at least one hollow area 622*b*, wherein the hit areas 622*a* are used to form the X-ray generating areas XA for generating the X-ray 70 that passes through the end window 211 after the portion ESa of the electron beam ES hits the hit areas 622*a* of the second substrate 622. In other words, in this embodiment, the material for generating the X-ray (i.e., the second substrate 622) is formed on the anode target 620 in a hollow-out manner. Accordingly, the area of the anode target 620 for generating the X-ray 70 is reduced to turn the X-ray to the small X-ray 70 and form a small point ray source, thereby achieving the subsequent phase contrast effect. Moreover, the risk of meltdown of the anode target 620 due to excessive concentration of the heat that occurs when the electron beam ES hits the anode target 620 is also reduced. When the anode target 620 is used as the anode target 420 of the X-ray source 400, the X-ray source 400 achieves effects similar to the X-ray source 200. Details thereof are not repeated here.

Figure 7A:
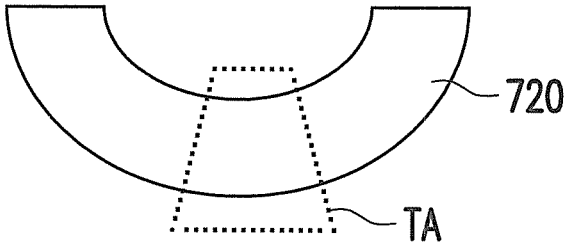
FIG. 7A is a schematic front view of yet another anode target of the X-ray source of FIG. 4.
Figure 7B:
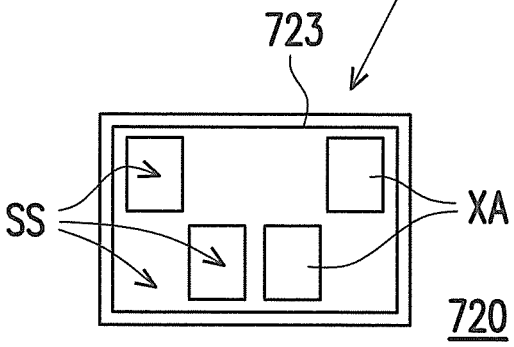
FIG. 7B is a schematic enlarged view of a partial area of the anode target of FIG. 7A.
Figure 7C:
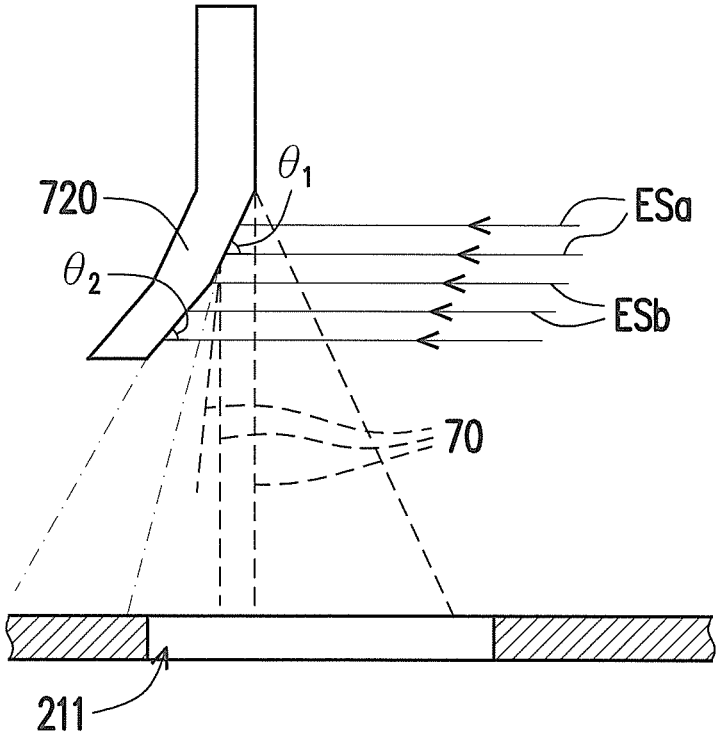
FIG. 7C is a schematic view of an X-ray generated by the X-ray source of FIG. 7A.

FIG. 7A is a schematic front view of yet another anode target 720 of the X-ray source 400 of FIG. 4. FIG. 7B is a schematic enlarged view of a partial area of the anode target 720 of FIG. 7A. FIG. 7C is a schematic view of an X-ray 70 generated by the X-ray source of FIG. 7A. With reference to FIG. 7A and FIG. 7B, in this embodiment, an anode target 720 includes a third substrate 723. More specifically, the third substrate 723 is disposed between the anode target 720 and the cathode 230 and includes a plurality of surface micro-structures SS. To be more specific, an incident angle θ1 at which the portion ESa of the electron beam ES enters a portion of the surface micro-structures SS on the X-ray generating areas XA is different from an incident angle θ2 at which the another portion ESb of the electron beam ES enters a portion of the surface micro-structures SS located outside the X-ray generating areas XA. Further, as shown in FIG. 7C, in this embodiment, the incident angles θ1 and θ2 are designed such that only the X-ray 70 generated by the X-ray generating areas XA passes through the end window 211 while the X-ray generated by other areas is not emitted out through the end window 211. In other words, the X-ray 70 that passes through the end window 211 is generated from the portion ESa of the electron beam ES that enters the surface micro-structures SS located on the X-ray generating areas XA. Accordingly, the micro-focal-spot area formed by the X-ray source 200 is reduced and applicable for radiographing clinical samples.

Figure 8:
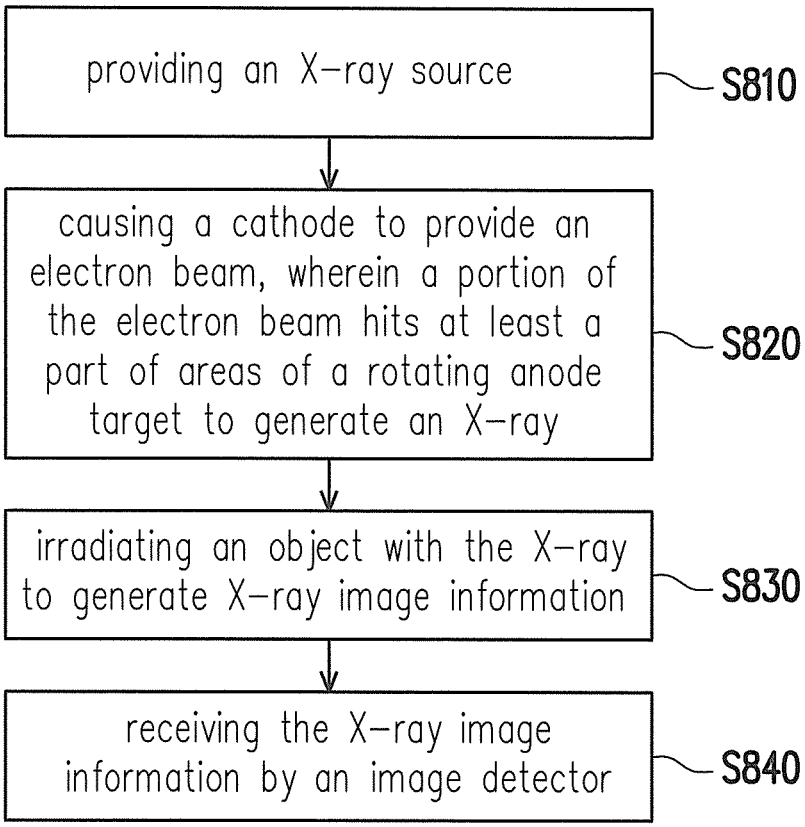
FIG. 8 is a flowchart of an X-ray imaging method according to an embodiment of the disclosure.

FIG. 8 is a flowchart of an X-ray imaging method according to an embodiment of this disclosure. With reference to FIG. 8, in this embodiment, the X-ray imaging method is executed with use of the X-ray imaging system 100 of FIG. 1, for example. The X-ray imaging method of this embodiment is a phase contrast X-ray imaging (PCXI) method, for example. However, it is noted that this disclosure is not limited thereto. Hereinafter, steps of the X-ray imaging method of this embodiment are described in detail with reference to each component in the X-ray imaging system 100.

First, Step S810 is executed to provide an X-ray source 200. In this embodiment, the X-ray source may be the X-ray source 200 of FIG. 2 or the X-ray source 400 of FIG. 4. Next, Step S820 is executed to cause the cathode 230 to provide the electron beam ES. The portion ESa of the electron beam ES hits at least partial areas of the rotating anode target 220 (or the anode target 420, 620, or 720) to generate the X-ray 70. The X-ray 70 is emitted out of the housing 210 through the end window 211. More specifically, if the X-ray source is the X-ray source 200 of FIG. 2, a method of generating the X-ray 70 from the portion ESa of the electron beam ES includes shielding the another portion ESb of the electron beam ES with the shielding unit 240 while the portion ESa of the electron beam ES passes through the shielding unit 240 through the opening 241 of the shielding unit 240 (as shown in FIG. 3C) to hit the rotating anode target 220.

If the X-ray source is the X-ray source 400 of FIG. 4, the method of generating the X-ray 70 from the portion ESa of the electron beam ES includes causing the electron beam ES to hit the rotating anode target 420 (or the anode target 620 or 720), wherein the portion ESa of the electron beam ES hits the X-ray generating areas XA of the anode target 420 (or the anode target 620 or 720) while the another portion ESb of the electron beam ES hits areas other than the X-ray generating areas XA of the anode target 420 (or the anode target 620 or 720), and the X-ray 70 that passes through the end window 211 is generated by the hitting of the portion ESa of the electron beam ES on the X-ray generating areas XA. Specifically, in this embodiment, the X-ray generating areas XA may have the structure of the anode target 420, 620, or 720 as respectively shown in FIG. 5B, FIG. 6B, or FIG. 7B.

Then, Step S830 is executed to irradiate the object O with the X-ray 70, so as to generate X-ray image information. Thereafter, Step S840 is executed to receive the X-ray image information by the image detector 150. Accordingly, the X-ray imaging method of this embodiment utilizes the portion ESa of the electron beam ES from the X-ray source 200 (or the X-ray source 400) of the X-ray imaging system 100 to hit the X-ray generating areas XA of the anode target 220 (or the anode target 420, 620, or 720), so as to reduce the hit area of the anode target 220, turn the X-ray into the small X-ray 70, and form a small point ray source, thereby achieving the subsequent phase contrast effect. Moreover, the risk of meltdown of the anode target 220 (or the anode target 420, 620, or 720) due to excessive concentration of the heat that occurs when the electron beam ES hits the anode target 220 (or the anode target 420, 620, or 720) is also reduced. Thus, in a situation where the power of the X-ray source 200 (or the X-ray source 400) is enhanced, the X-ray imaging system 100 and the X-ray source 200 (or the X-ray source 400) of this embodiment maintain a certain degree of reliability and are applicable for radiographing clinical samples.

Other details of the steps of the X-ray imaging method of this embodiment have been specified above in the embodiments of the X-ray imaging system 100 and thus are not repeated hereinafter.

In conclusion, the X-ray imaging system 100 and the X-ray imaging method of this disclosure utilize a portion ESa of the electron beam ES from the cathode 230 to hit different areas of the anode target, so as to reduce the hit area of the anode target, turn the X-ray into the small X-ray beam, and form a small point ray source, thereby achieving the subsequent phase contrast effect. Moreover, the risk of meltdown of the anode target due to excessive concentration of the heat that occurs when the electron beam hits the anode target is also reduced. Therefore, in a situation where the power of the X-ray source is enhanced, the X-ray imaging system 100 and the X-ray source of the embodiments of this disclosure maintain a certain degree of reliability and are suitable for photographing clinical samples.

It will be apparent to those skilled in the art that various modifications and variations can be made to the disclosed embodiments without departing from the scope or spirit of this disclosure. In view of the foregoing, it is intended that the disclosure covers modifications and variations provided that they fall within the scope of the following claims and their equivalents.

What is claimed is:

1. An X-ray source, adapted to provide an X-ray, the X-ray source comprising:

a housing comprising an end window, wherein the X-ray is emitted out of the housing through the end window;

an anode target disposed beside the end window and adapted to rotate around an axis;

a cathode disposed in the housing and adapted to provide an electron beam, wherein a portion of the electron beam hits the rotating anode target to generate the X-ray that passes through the end window; and a shielding unit comprising an opening and disposed on a traveling path of the electron beam and between the cathode and the anode target for shielding another portion of the electron beam, wherein the portion of the electron beam that hits the anode target passes through the shielding unit through the opening of the shielding unit.

2. The X-ray source according to claim 1, wherein the opening of the shielding unit rotates relative to the anode target, and the opening is adapted to rotating around a central axis of the shielding unit.

3. The X-ray source according to claim 2, wherein the central axis is consistent with a central point of the electron beam.

4. The X-ray source according to claim 1, wherein a center of the opening of the shielding unit is aligned with a center of the electron beam.

5. An X-ray source, adapted to provide an X-ray, the X-ray source comprising:

a housing comprising an end window, wherein the X-ray is emitted out of the housing through the end window;

an anode target disposed beside the end window and adapted to rotate around an axis, wherein the anode target comprises a plurality of X-ray generating areas; and a cathode disposed in the housing and adapted to provide an electron beam, wherein a portion of the electron beam hits the plurality of X-ray generating areas of the rotating anode target to generate the X-ray while another portion of the electron beam hits areas of the anode target other than the plurality of X-ray generating areas of the anode target, and the X-ray generated by the hitting of the portion of the electron beam on the plurality of X-ray generating areas is emitted out through the end window, and wherein an arrangement track of the plurality of X-ray generating areas on the anode target has a sinusoidal shape.

6. The X-ray source according to claim 5, wherein the anode target comprises:

a first substrate; and a second substrate disposed between the first substrate and the cathode and covering a portion of a surface of the first substrate to form the plurality of X-ray generating areas, wherein the portion of the electron beam hits the second substrate to generate the X-ray that passes through the end window.

7. The X-ray source according to claim 6, wherein the first substrate is a heat dissipation substrate.

8. The X-ray source according to claim 6, wherein the first substrate is fonned of a material that is not capable of generating electromagnetic radiation in an X-ray band, and the second substrate is formed of a material that is capable of generating electromagnetic radiation in an X-ray band.

9. The X-ray source according to claim 6, wherein the anode target comprises:

a second substrate disposed between the anode target and the cathode, wherein the second substrate comprises a plurality of hit areas and at least one hollow area, wherein the plurality of hit areas form the plurality of X-ray generating areas and the second substrate is formed of a material that is capable of generating electromagnetic radiation in an X-ray band.

10. The X-ray source according to claim 6, wherein the anode target comprises:

a third substrate disposed between the anode target and the cathode, wherein the third substrate comprises a plurality of surface micro-structures, and an incident angle at which the electron beam enters a portion of the plurality of surface micro-structures located on the plurality of X-ray generating areas is different from an incident angle at which the electron beam enters a portion of the plurality of surface micro-structures located outside the plurality of X-ray generating areas, and the X-ray that passes through the end window is generated from a portion of the electron beam that enters the portion of the plurality of surface micro-structures located on the plurality of X-ray generating areas.

11. An X-ray imaging method, comprising:

providing an X-ray source, comprising a housing having an end window, a cathode disposed in the housing, and a rotating anode target disposed beside the end window;

causing the cathode to provide an electron beam, and causing a portion of the electron beam to hit at least a part of areas of the rotating anode target to generate an X-ray, wherein the X-ray is emitted out of the housing through the end window;

causing the X-ray to irradiate an object to generate X-ray image information; and receiving the X-ray image information by an image detector, wherein the X-ray source further comprises a shielding unit disposed on a traveling path of the electron beam, and wherein the step of causing the portion of the electron beam to hit at least a part of areas of the rotating anode target to generate the X-ray comprises:

shielding another portion of the electron beam with the shielding unit, wherein the portion of the electron beam passes through the shielding unit through an opening of the shielding unit to hit the rotating anode target.

12. The X-ray imaging method according to claim 11, wherein the opening of the shielding unit rotates relative to the rotating anode target, and the opening of the shielding unit is adapted to rotate around a central axis of the shielding unit.

13. The X-ray imaging method according to claim 11, wherein a rotation speed of the shielding unit is set such that one rotation of the shielding unit takes an exposure time to complete a single radiograph.

14. The X-ray imaging method according to claim 11, wherein an imaging time of the object is a multiple of a ratio of areas of the electron beam reduced by the shielding unit.

15. An X-ray imaging method, comprising:

providing an X-ray source, comprising a housing having an end window, a cathode disposed in the housing, and a rotating anode target disposed beside the end window;

causing the cathode to provide an electron beam, and causing a portion of the electron beam to hit at least a part of areas of the rotating anode target to generate an X-ray, wherein the X-ray is emitted out of the housing through the end window;

causing the X-ray to irradiate an object to generate X-ray image information; and receiving the X-ray image information by an image detector, wherein the step of causing the portion of the electron beam to hit the at least a part of areas of the rotating anode target to generate the X-ray comprises:

causing the portion of the electron beam to hit a plurality of X-ray generating areas of the rotating anode target while the another portion of the electron beam hits areas other than the plurality of X-ray generating areas of the rotating anode target, wherein the X-ray that passes through the end window is generated by the hitting of the portion of the electron beam on the plurality of X-ray generating areas, and wherein an imaging time of the object is a multiple of an area of the electron beam reduced by the rotating anode target.

16. The X-ray imaging method according to claim 15, wherein the rotating anode target comprises a first substrate and a second substrate disposed between the first substrate and the cathode, and the second substrate covers a portion of a surface of the first substrate to form the plurality of X-ray generating areas, wherein the portion of the electron beam hits the second substrate to generate the X-ray that passes through the end window.

17. The X-ray imaging method according to claim 15, wherein the rotating anode target comprises a second substrate disposed between the rotating anode target and the cathode, and the second substrate comprises a plurality of hit areas and at least one hollow area, wherein the plurality of hit areas form the plurality of X-ray generating areas such that the portion of the electron beam generates the X-ray that passes through the end window after the electron beam hits the plurality of hit areas of the second substrate.

18. The X-ray imaging method according to claim 15, wherein the rotating anode target comprises a third substrate disposed between the rotating anode target and the cathode, and the third substrate comprises a plurality of surface micro-structures, wherein an incident angle at which the electron beam enters a portion of the plurality of surface micro-structures located on the plurality of X-ray generating areas is different from an incident angle at which the electron beam enters a portion of the plurality of surface micro-structures located outside the plurality of X-ray generating areas, and the X-ray that passes through the end window is generated from the portion of the electron beam that enters the portion of the plurality of surface micro-structures located on the plurality of X-ray generating areas.

* * * * *